US006547706B1

(12) United States Patent
Chek

(10) Patent No.: US 6,547,706 B1
(45) Date of Patent: Apr. 15, 2003

(54) RACK EXERCISE SYSTEM AND METHOD

(75) Inventor: Paul W. Chek, Encinitas, CA (US)

(73) Assignee: Paul Chek Seminars, Encinitas, CA (US)

( * ) Notice: Subject to any disclaimer, the term of this patent is extended or adjusted under 35 U.S.C. 154(b) by 0 days.

(21) Appl. No.: 09/622,080

(22) PCT Filed: Feb. 10, 1999

(86) PCT No.: PCT/US99/02825

§ 371 (c)(1),
(2), (4) Date: Aug. 10, 2000

(87) PCT Pub. No.: WO99/40976

PCT Pub. Date: Aug. 19, 1999

Related U.S. Application Data

(60) Provisional application No. 60/074,715, filed on Feb. 13, 1998.

(51) Int. Cl.[7] ..... A63B 71/00

(52) U.S. Cl. ..... 482/148; 482/95; 482/96; 482/132

(58) Field of Search ..... 482/23, 121, 123, 482/129–134, 140, 142, 148, 143, 95, 96, 24, 27, 28, 144, 146; 472/127, 134, 135; 601/23; 273/1.5 R, 25, 58 R, 317

(56) References Cited

U.S. PATENT DOCUMENTS 4,696,470 A 9/1987 Fenner
4,848,742 A * 7/1989 Linflry ..... 272/144
4,921,245 A 5/1990 Roberts
5,626,546 A 5/1997 Little
5,810,700 A 9/1998 Orcutt
5,833,587 A * 11/1998 Strong et al. ..... 482/123
6,213,924 B1 * 4/2001 Kaiyoorawongs ..... 482/146

OTHER PUBLICATIONS

Carrier, Beate, "Supplement to the course in Swiss Ball Exercises," *Springer–Verlag Berlin Heidelberg, New York*, 48 pages (1991).

Flaghouse, Inc., "Special Populations," *Physical Therapy Products Brochure*, p. 7 (Spring 1995 issue).

Holbrook, Tom, "Specialization," *Strength and Health Magazine* p. 41 (1971).

* cited by examiner

*Primary Examiner*—Nicholas D. Lucchesi
*Assistant Examiner*—Lori Baker Amerson
(74) *Attorney, Agent, or Firm*—Gray Cary Ware & Freidenrich, LLP

(57) ABSTRACT

A rack exercise system (30), according to the invention, having a main support frame (38), two upright support racks (42), a base frame, and a floor unit (36), for conditioning in three-dimensions using a mobile support (32) such as a Swiss ball. The rack excerise system is a multi-capability platform, or anchoring system that, in conjunction with the Swiss ball, allows an exercise or rehabilitation professional or an exercise enthusiast to fully express their creativity in exercise design, and selection.

14 Claims, 18 Drawing Sheets

RACK EXERCISE SYSTEM AND METHOD

This application claims benefit of provisional application No. 60/074,715 filed Feb. 13, 1998.

FIELD OF THE INVENTION

The invention relates to total body conditioning and, more particularly to a rack exercise system for use in calisthenics and resistance training. The rack exercise system allows a person to emphasis core conditioning, i.e., conditioning for the person's trunk region of the body, in addition to conditioning of the person's extremities.

BACKGROUND OF THE INVENTION

Existing conditioning and training systems often reside in stationary machines and equipment that provide resistance using pulleys or levers with one or more axes of rotation. Such machines often require the exercise to be performed while the person is in a seated position affording exercise in the sagittal plane (front to back or flexion and extension) while limiting the exerciser's ability to move in unguided movement patterns. Thus, existing conditioning machines generally do not require the exerciser to maintain their center of gravity over a specific base of support as in normal human movement.

Accordingly, such conditioning and training systems are based on unnatural human movements which fail to provide conditioning for real life movements often encountered in sports and in work in which strength must be generated and force applied in a three-dimensionally unstable environment. Further, such existing systems generally condition the exerciser's extremities, i.e., arms and legs, while ignoring the important trunk portion of the body.

From the discussion above, it should be apparent that there is a need for a conditioning system that exercises a person's trunk and extremities using three-dimensional movements while exercising balance. The present invention addresses these needs.

SUMMARY OF THE INVENTION

The present invention is embodied in a method for conditioning a person's body. The method includes anchoring the person's extremities to anchor points, supporting the body on a flexible support, and having the person perform exercise maneuvers.

In more detailed features of the invention, the flexible support may be a Swiss ball and the exercise maneuvers may include throwing a medicine ball in a three-dimensional movement.

The anchoring may be provided by a rack exercise system. The rack exercise system may include an upright unit having adjustable hold units for anchoring and a floor unit having swivel holds for anchoring.

Other features and advantages of the present invention should become apparent from the following description of the preferred embodiments, taken in conjunction with the accompanying drawings, which illustrate, by way of example, the principles of the invention.

BRIEF DESCRIPTION OF THE PREFERRED EMBODIMENTS

Figure 1:
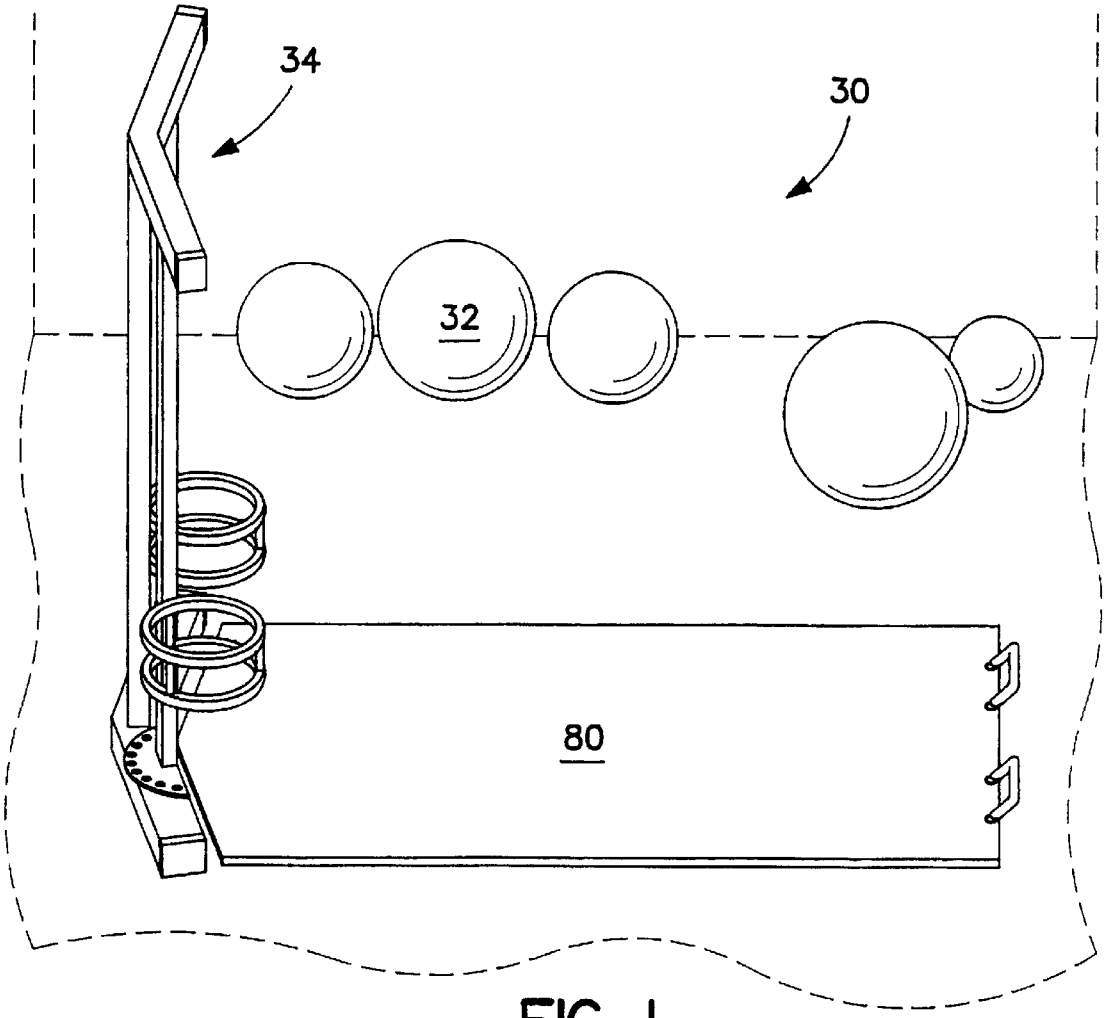
FIG. 1 is a perspective view of a rack exercise system, according to the invention, having a main support frame, two side upright support racks, a base frame, and a floor, for conditioning in three-dimensions using a Swiss ball.
Figure 4:
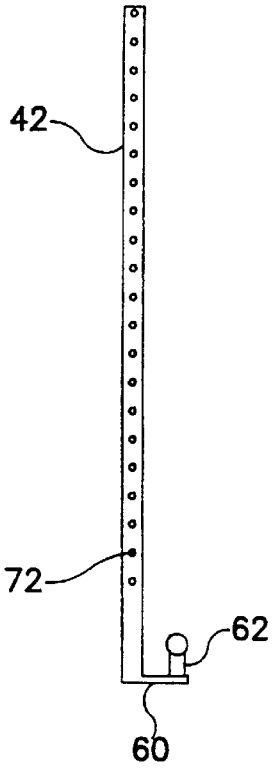
FIG. 4 is a side elevation view of a side upright support rack of FIG. 1.
Figure 2:
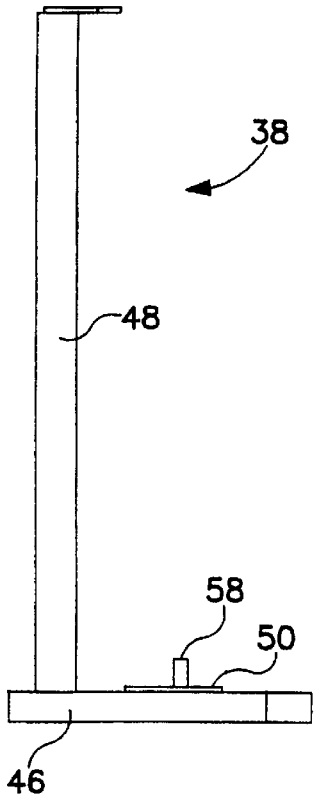
FIG. 2 is a side elevation view of the main support frame of FIG. 1.
Figure 5:
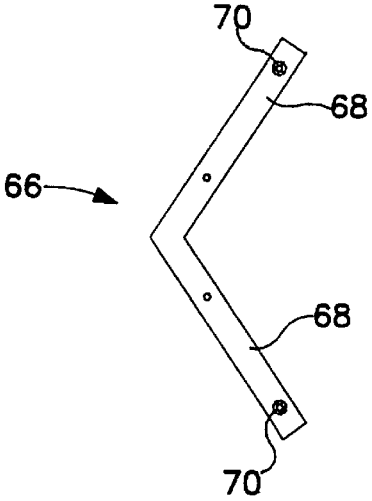
FIG. 5 is a plan view of a top clamp for attaching to the end of the main support frame and the ends of the side upright support racks.
Figure 3:
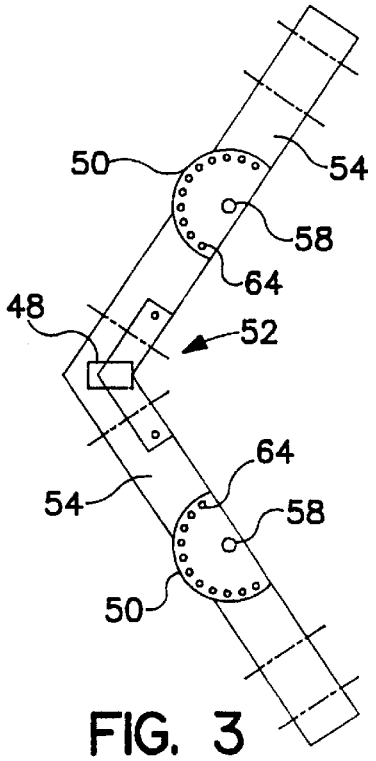
FIG. 3 is plan view of the main support frame of FIG. 2, which includes two mounting points for the two side upright support racks and includes two angle-selection plates for selecting the angular position of the respective upright support racks.
Figure 7B:
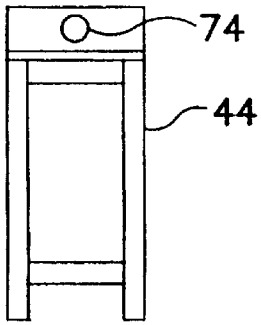
FIG. 7B is a side elevation view of the adjustable foot and hand hold unit of FIG. 7A.
Figure 7A:
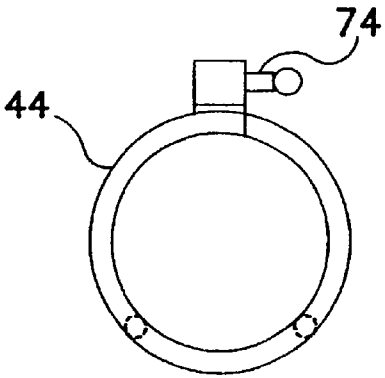
FIG. 7A is a plan view of an adjustable upper foot and hand hold unit, for attachment to each of the side upright supports.
Figure 9B:
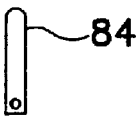
FIG. 9B is a side elevation view of the lower swivel hand and foot hold of FIG. 9A.
Figure 9A:
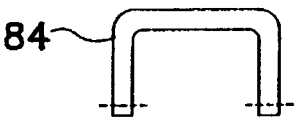
FIG. 9A is a front elevation view of a lower swivel hand and foot hold for attachment to the base frame of FIG. 8A.
Figure 6B:
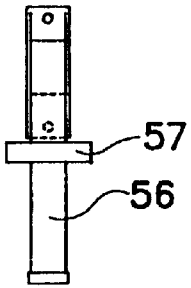
FIG. 6B is a front elevation view of the 45 degree brace of FIG. 6A.
Figure 6A:
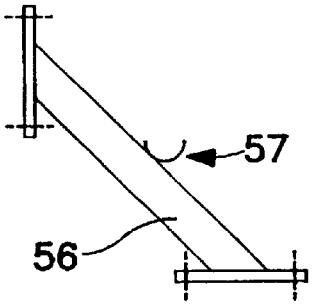
FIG. 6A is side elevation view of a 45 degree brace for strengthening the main support frame and holding a dumbbell.
Figure 8A:
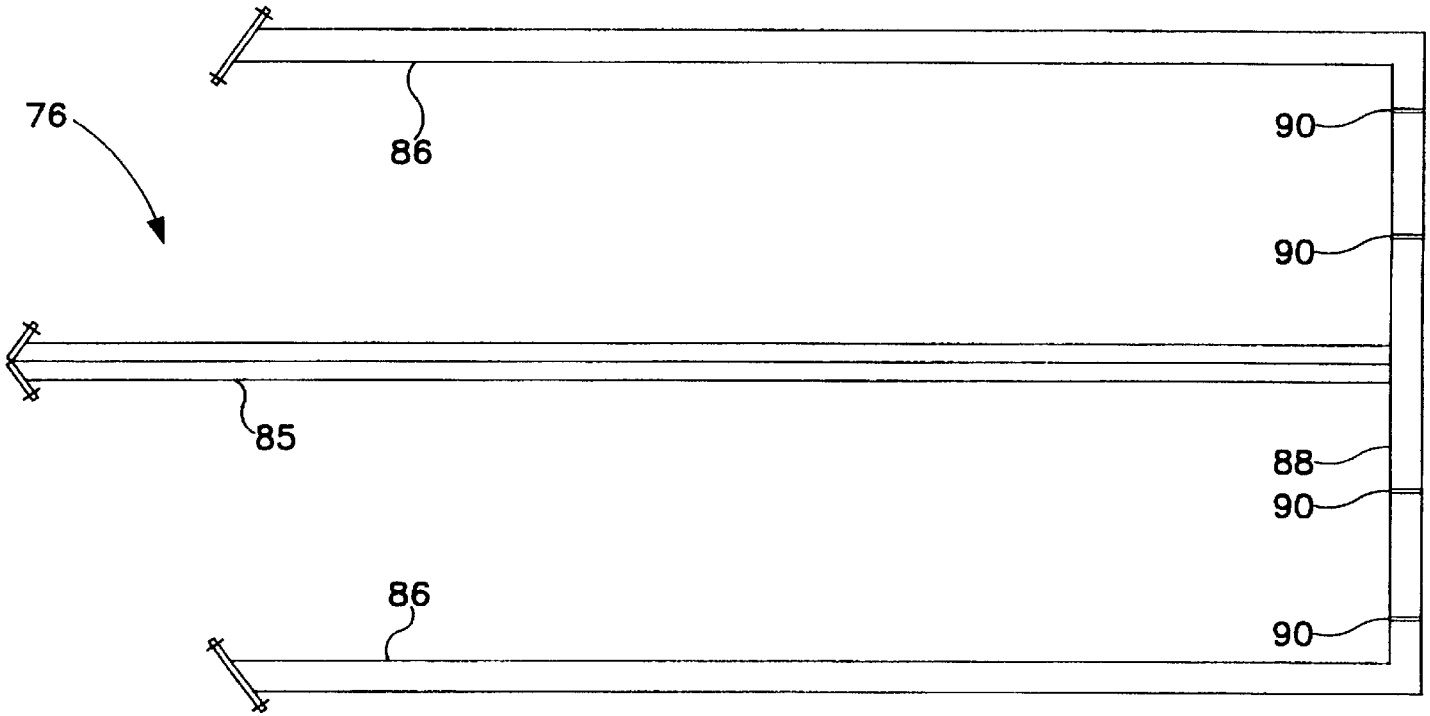
FIG. 8A is a plan view of the base frame of FIG. 1.
Figure 8B:
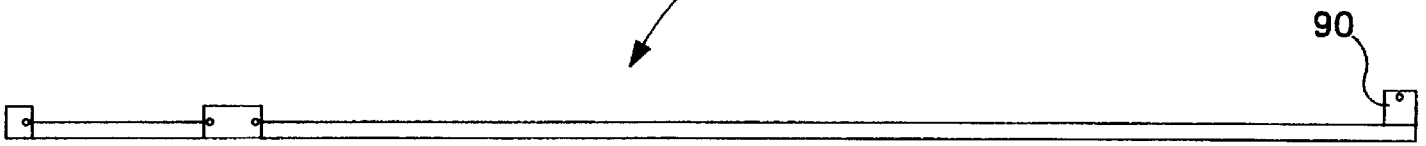
FIG. 8B is a side elevation view of the base frame of FIG. 8A.
Figure 10:
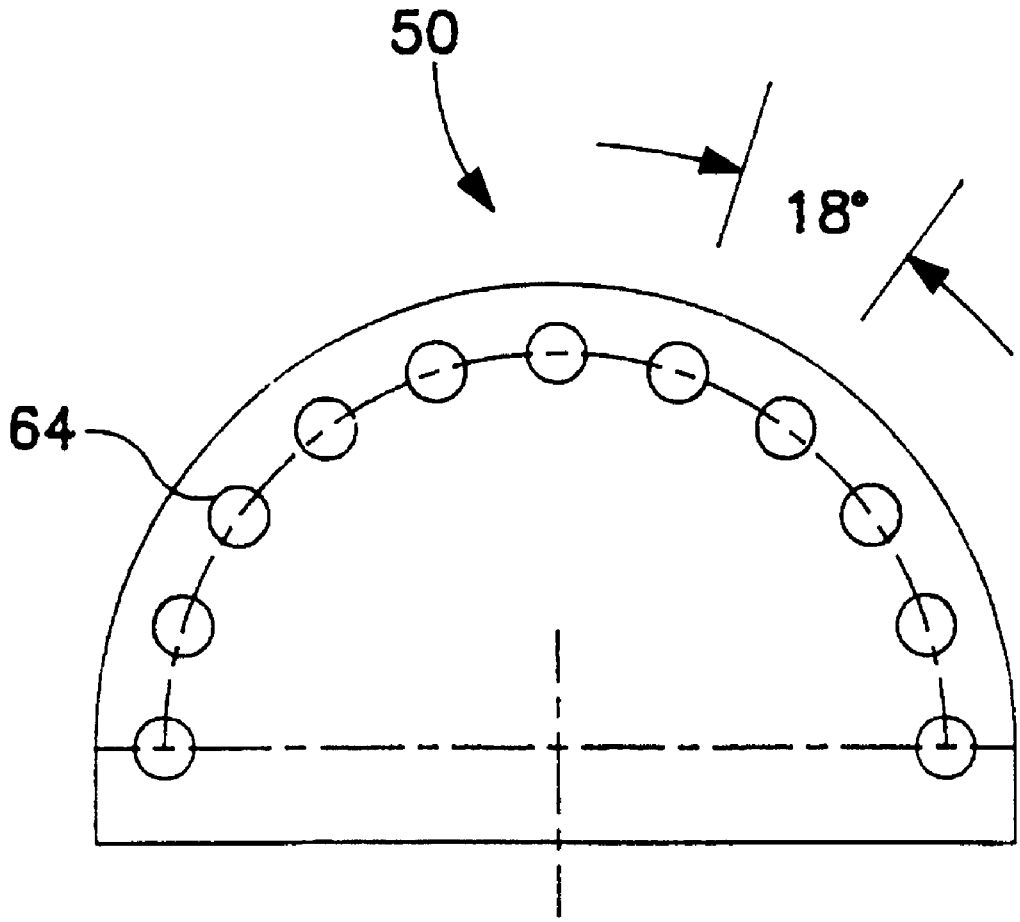
FIG. 10 is a plan view of the angle-selection plate of FIG. 3.

As shown in the exemplary drawings, the invention is embodied in a rack exercise system that provides a system of adjustable anchors and fixed anchors for use in conjunction with a mobile support, such as a Swiss ball. The anchors allow the exerciser to securely anchor the body using the arms or legs at a variety of heights and angles and to thus train and condition the body with isotonic or "dynamic" resistance. The conditioning may be performed at nearly any movement speed, in any plane or combinations of movement planes, or in movement patterns having a high functional carryover to home, work, or sports environments. The system thus provides an effective conditioning opportunity for exercisers of all ages, levels of functional capacity (injured to fully functional), and gender.

With reference now to FIGS. 1–10, the rack exercise system 30 includes an upright unit 34 and a floor unit 36. The upright unit includes a main support frame 38, two side upright support racks 42, and two adjustable foot and hand hold units 44. The main support frame 38 includes a main support base 46, a main support post 48, and two angle selection plates 50. The main support base is V-shaped having an apex 52 and two arms 54. The main support post is attached by bolts to the main support base at the apex. The main support post is fortified by a 45 degree brace 56 bolted between the main support post and the floor unit 36. The 45 degree race includes a dumbbell rack 57. Each angle selection plate is attached to the respective base arm at a location that is approximately midway between the apex and the end of the respective base arm.

Each of the two side upright support racks 42 is mounted on a peg 58 located at a pivot mounting point on the respective angle selection plate 50. Each upright support rack has a tab 60 on its lower end which includes a spring-loaded pin 62 that engages holes 64 located at spaced apart angles on the angle selection plates. Accordingly, the upright support rack may rotate 180 degrees about the pivot point and be locked to a desired angle, in 18 degree steps, by engaging the pin in the appropriate hole on the angle selection plate. A V-shaped top clamp 66 having two arms 68 is connected to the top end of the main support post 48. On each arm is a peg 70 that engages a hole in the top end of the respective upright support rack 42 for supporting the support racks in their upright positions. Each upright support rack further includes a series of spaced-apart holes 72 along its length.

The adjustable foot and hand hold units 44 slidingly engage the upright support racks 42. Each adjustable hold includes a spring-load pin 74 that engages the hole 72 on the upright support rack. Thus, the height of the hand and foot hold unit is set by sliding the unit along the upright support rack and engaging the pin in the appropriate hole.

The floor unit 36 includes a base frame 76, a floor 80, a gymnastic pad 82, and two lower swivel hand and foot holds 84. The base frame has a base frame center piece 85 and two side pieces 86 that are all connected by an end piece 88. The center piece is bolted to the main support base 46 at the support base's apex. The two side pieces, respectively, are bolted to the support base's two arms. The two lower swivel holds 84 are attached the base frame's end piece by tabs 90. The floor of plywood timber is placed over the base frame and the gymnastics pad (not shown) is placed on the floor. Accordingly, the lower swivel holds are located on a side of the floor that is opposite that of the adjustable hold units 44.

The mobile support 32 is preferably a Swiss ball. The Swiss ball is advantageous because it allows for the performance of a wide variety of conditioning activities. The mobile support also may be a ball or the like that is weighted with sand, gel, stuffing, or that has a heavy shell material.

One advantage from a rehabilitative perspective of the exercise system 30 of the invention is its use of "integration." Whereas existing conditioning machines predominantly "isolate" body parts and various musculature (such as the abdominals), the exercise system of the invention allows a vast array of both isolation exercises and integration exercises. Because the exercise system promotes exercises that are performed while one or both extremities act as an anchor point, an inherent improvement is obtained in a person's ability to functionally stabilize one or more regions of the body while either isolating or integrating other regions of the body in a particular exercise. The rack exercise system allows the user to perform numerous exercises that would normally require one to find an anchor in the gym, e.g., hooking feet under, or holding onto a machine. Anchoring to such existing machines is often dangerous and can be painful due to sharp edges and may provide less than optimal heights and widths of anchor points.

The rack exercise system 30 allows the user to select from a virtually unlimited number of exercises that range from very easy to very complex. The rack exercise system is primarily used to condition the core musculature of the body, although there are numerous exercises for the extremities that can be performed on it. Because the primary assisting modality of the system is the Swiss Ball 32, all exercises have some degree of "instability" that requires the exerciser to maintain balance at all times. The degree of balance needed is dependent upon the choice of anchor points.

Because the design strategy of the system is modality interactive, it allows the development of strength, endurance, flexibility, coordination, power, balance, speed and stabilization. The biomotor ability developed will depend greatly upon the choice of interactive modality(s) and user skill.

The rack exercise system of the invention generally should be accompanied by some degree of instruction. Preferably, an exerciser is provided with guidance regarding possible exercises, exercise design with an understanding of functional anatomy, and exercise program design.

The system 30 allows the exercise enthusiast or professional to select from a vast array of isolation and integration exercises. The system is designed to be used in concert with numerous other modalities such as dumbbells, medicine and Swiss balls, cable machines, etc. and therefore reflects the versatility of such an unlimited selection of possible exercises. The system requires significantly elevated demand upon the core musculature (trunk) due to the integrated nature of exercising with the body anchored at one end and having to move weighted or un-weighted extremities at the other end. This technique is particularly advantageous because research on human movement conclusively demonstrates that all movement patterns of the extremities emanate from the core. Therefore, training based on the rack exercise system of the invention will primarily improve core conditioning and functional capacity and secondarily enhance extremity movement and function. Thus, the exercise enthusiast, athlete, coach, or trainer may initially use integration exercises for the purposes of increased caloric expenditure (fat reduction), or increasing movement skills and strength in movement patterns which more closely approximate the home, work, or sports environment.

A rehabilitation professional may, however, choose to develop, select, and implement isolation exercises for regions such as the abdominals, low back or gluteus maximus as a prerequisite to advancing to more complex integration exercises.

With reference to FIGS. 11–22, the rack exercise system 30 may used alone or in conjunction with other apparatus such as dumbbells, medicine balls, body blades, balance boards, stretch cords, and cable free-weight resistance machines.

Figure 11:
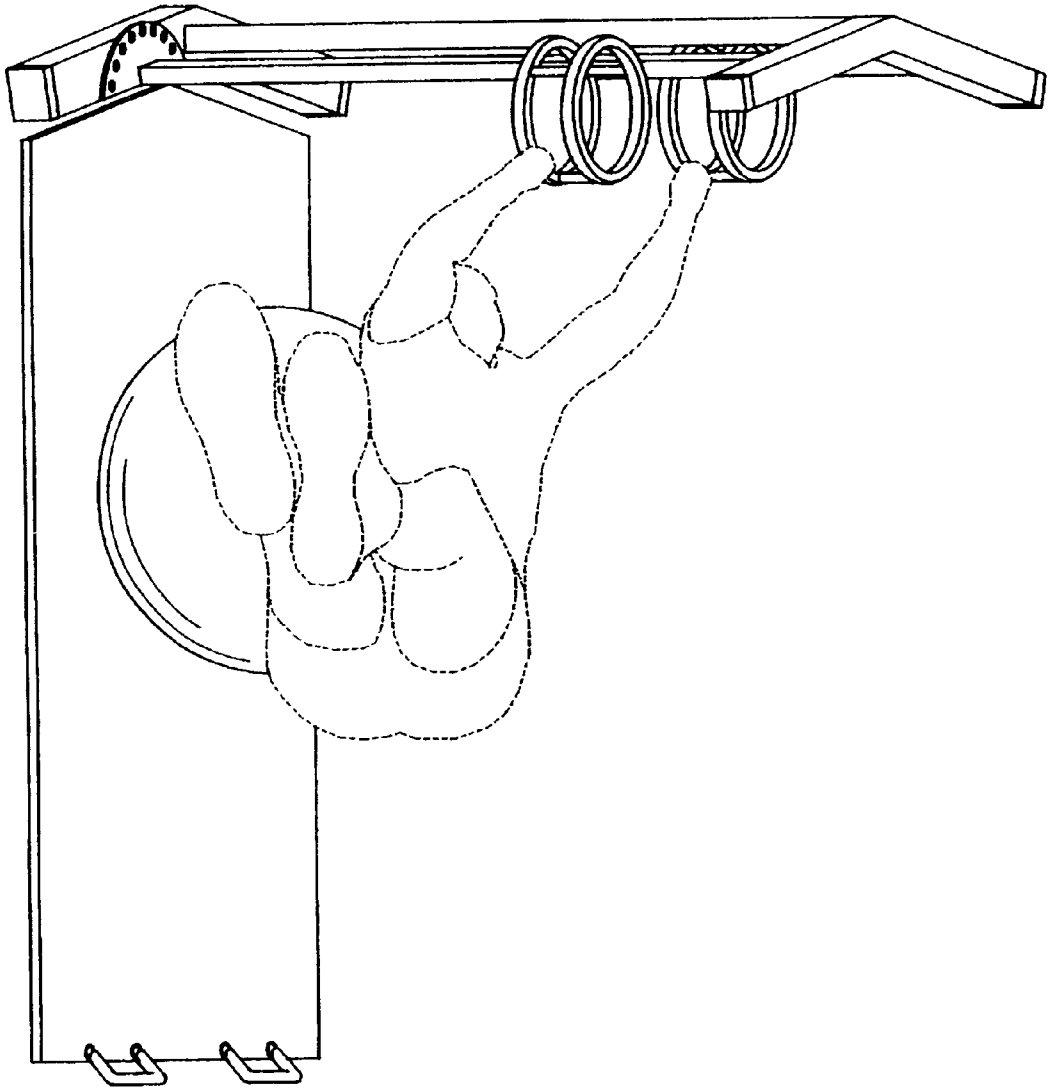
FIG. 11 is a perspective view of the rack exercise system of FIG. 1, showing a person performing core conditioning exercises with the hands grasping the adjustable foot and hand hold units while the units are in a raised position.

A first exercise modality is shown in FIG. 11 in which the user performs core conditioning with the hands grasping the adjustable foot and hand hold units 44. The adjustable hold units are in a raised position. This exercise shows the exerciser supporting his body weight and maintaining his center of gravity over a mobile support 32 via the upper extremities while performing a lower body rotation requiring trunk and leg motion in the transverse plane.

Figure 12:
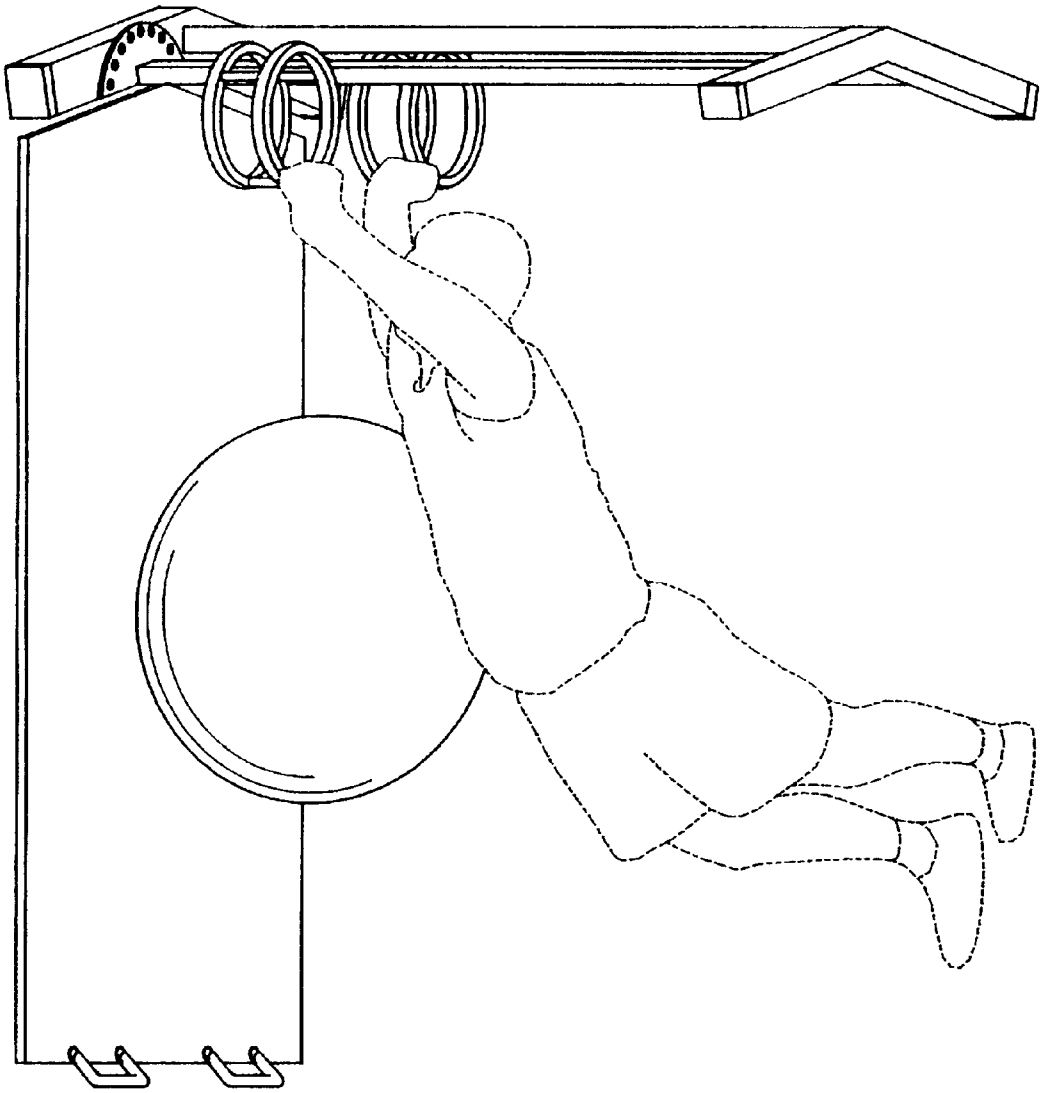
FIG. 12 is a perspective view of the rack exercise system of FIG. 1, showing a person performing core conditioning exercises with the hands grasping the adjustable hold units while the units are in a lowered position.

Another exercise modality is shown in FIG. 12 in which the exerciser performs core conditioning with the hands grasping the adjustable foot and hand hold units 44 while the units are in a lowered position. This exercise demonstrates how the exerciser may condition extensor muscles of the trunk and lower extremities as a functionally integrated unit. The exerciser's body is moving in the sagittal, frontal, and transverse planes of motion while being supported from the action of the hands and arms via the adjustable hold units.

Figure 13:
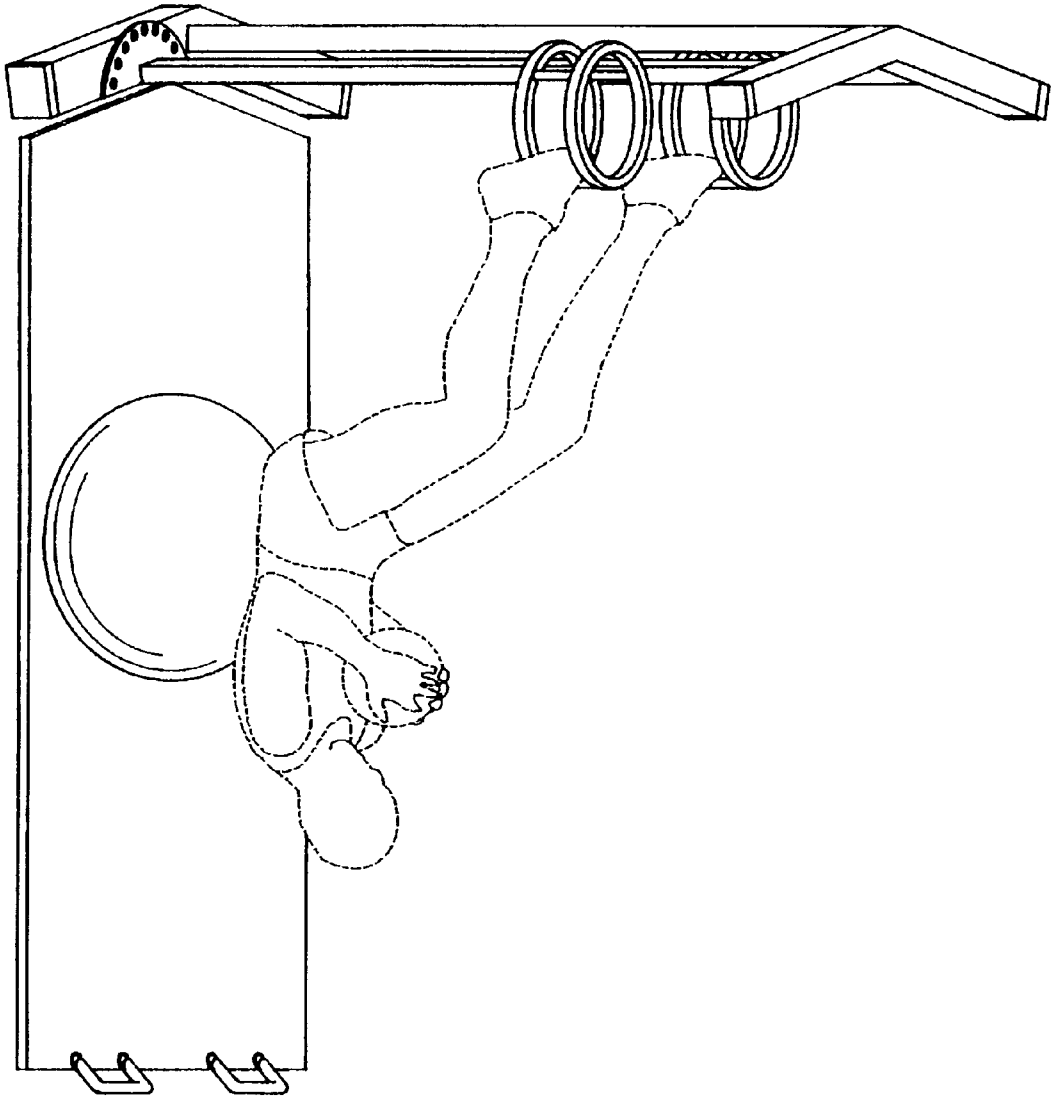
FIG. 13 is a perspective view of the rack exercise system of FIG. 1, showing a person performing an isolation conditioning exercise using dumbbells with the feet engaging the adjustable hold units while the units are in a raised and narrow position.

Another exercise modality is shown in FIG. 13 in which the exerciser performs an isolation conditioning exercise with the feet engaging the adjustable hold units 44 while the units are in a raised and narrow position. The ability to perform such trunk flexion exercises with the feet elevated affords the exerciser the ability to isolate and maximally load the abdominal region. By lowering the hold units, performance of the same exercise will result in a shift of the maximal load progressively upward. Accordingly, the rack exercise system 30 may be effectively integrated with multiple exercise modalities and forms of resistance to accomplish numerous results.

Figure 14:
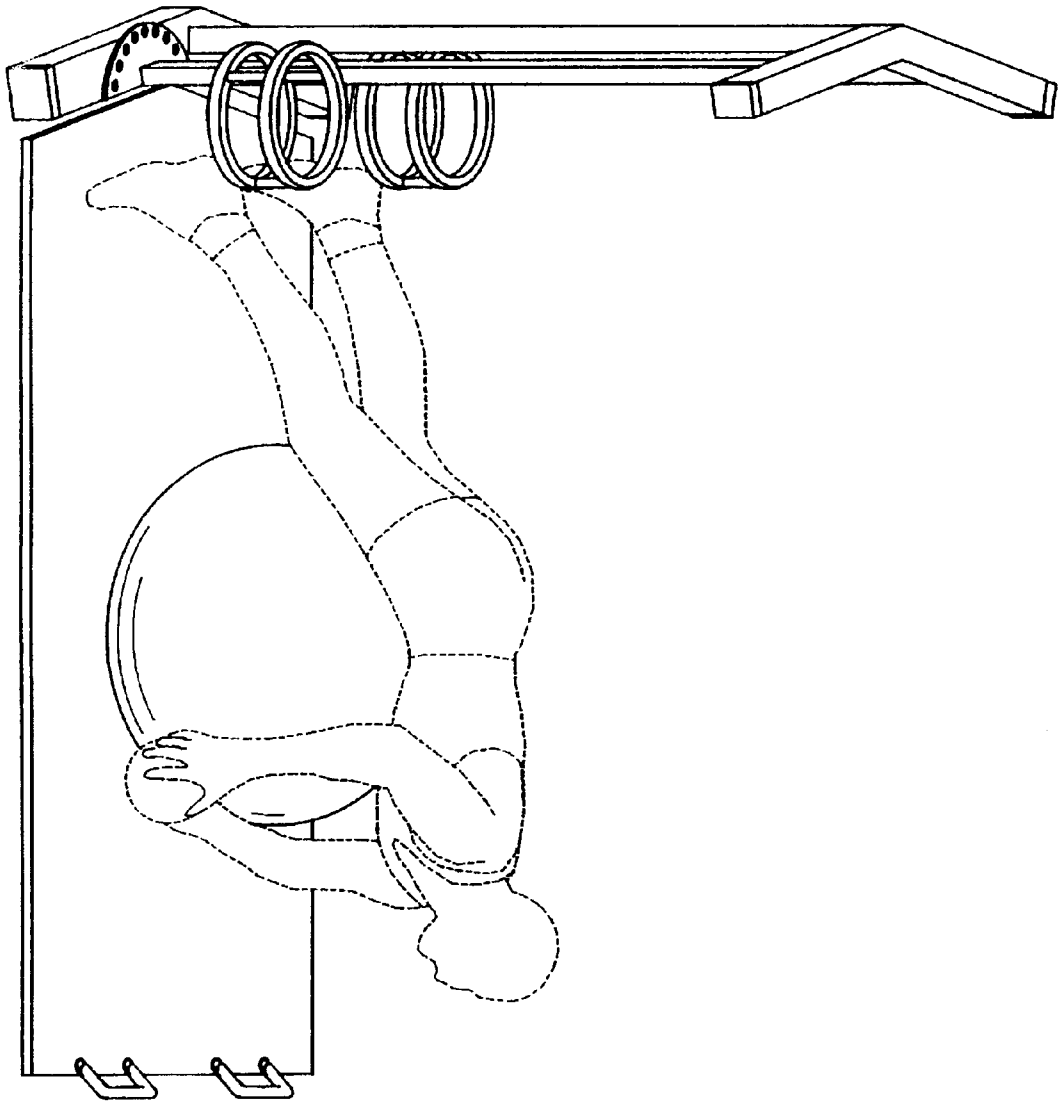
FIG. 14 is a perspective view of the rack exercise system of FIG. 1, showing a person performing core conditioning exercises using a medicine ball with the feet engaging the adjustable hold units while the units are in a lowered position.

Another exercise modality is shown in FIG. 14 in which the exerciser performs core conditioning by throwing a medicine ball while the feet are engaged in the adjustable hold units 44 which are in a lowered position. This exercise demonstrates how the back may be exercised in multiple planes of motion and at any speed of movement the exerciser desires to move or throw the medicine ball.

Figure 15:
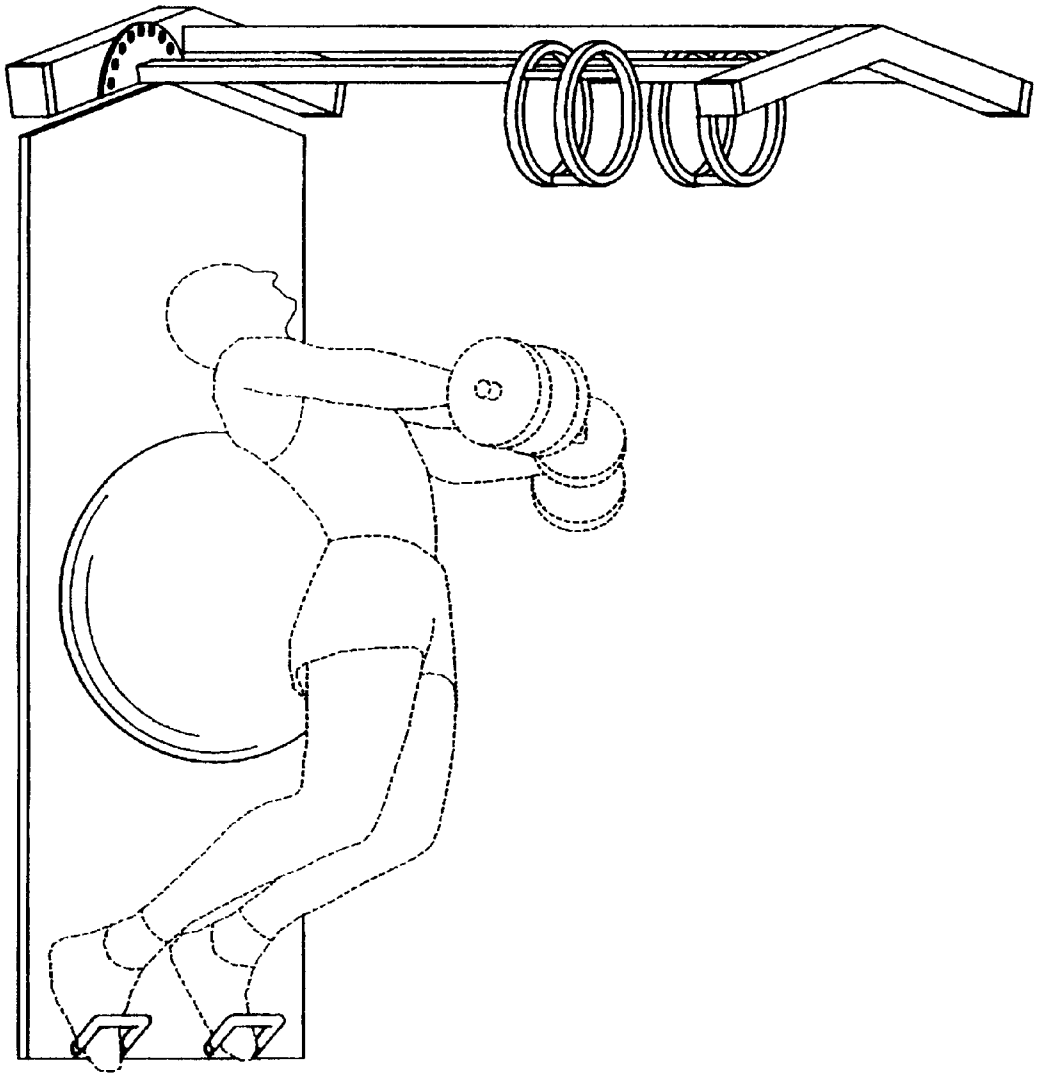
FIG. 15 is a perspective view of the rack exercise system of FIG. 1, showing a person performing upper extremity conditioning exercises using dumbbells with the feet engaging the lower swivel hand and foot holds.

Another exercise modality is shown in FIG. 15 in which the exerciser performs upper extremity conditioning using dumbbells with the feet engaging the lower swivel hand and foot holds 84. In this exercise, high resistance is being moved and stabilized by the upper extremities with the feet anchored while the exerciser is supported by a mobile, unstable ball 32 under the exerciser's body. Accordingly, the core is conditioned by necessity of its communication and connection duties between the upper and lower extremities. This exact situation is common to many work and sports environments. Performance of the exercise at various positions atop the ball affords strengthening of different muscle fiber groups of the pectoral and arm musculature. This form of movement variety is not common among traditional exercise machines.

Figure 16:
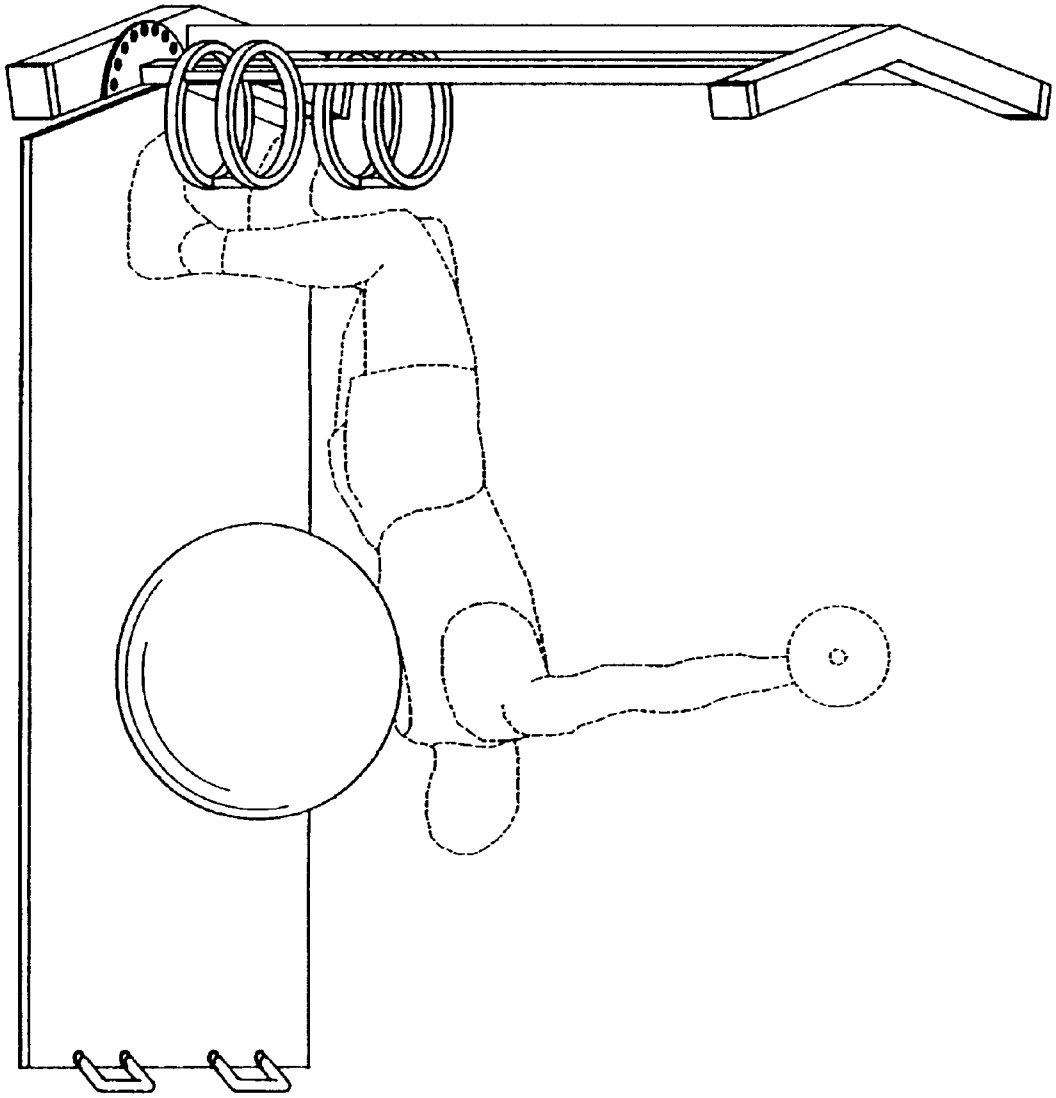
FIG. 16 is a perspective view of the rack exercise system of FIG. 1, showing a person performing core conditioning exercises using dumbbells with the feet engaging the adjustable hold units while the units are in a lowered position.

Another exercise modality is shown in FIG. 16 in which the exerciser performs core and upper extremity conditioning using dumbbells with the feet engaging the adjustable hold units 44 while the units are in a lowered position. This exercise demonstrates how the rack exercise system 30 of the invention effectively integrates the upper extremities, core, and lower extremities to perform a functional movement pattern while maintaining the exerciser's base of support.

Figure 17:
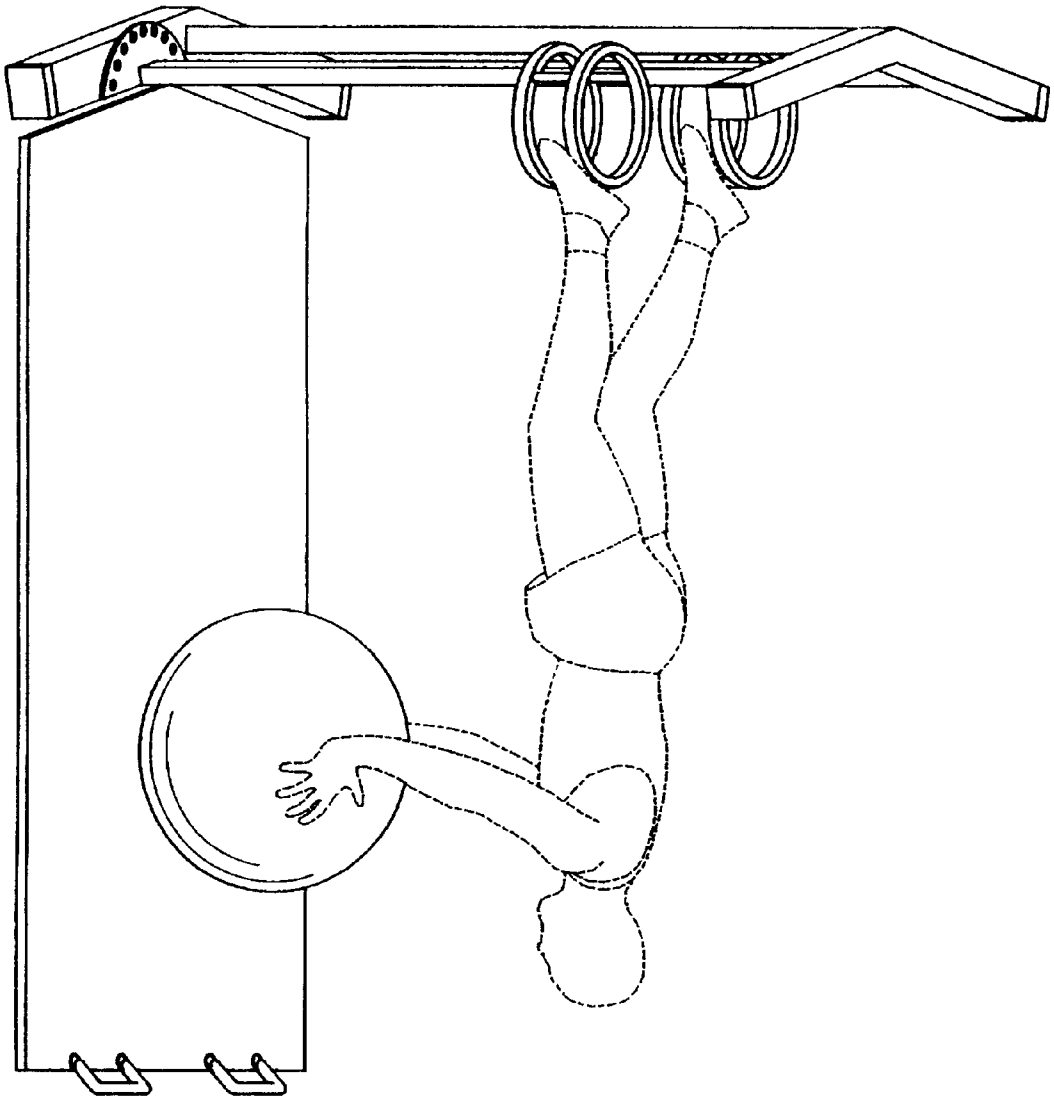
FIG. 17 is a perspective view of the rack exercise system of FIG. 1, showing a person performing core conditioning exercises with the feet engaging the adjustable hold units while the units are in a raised and narrow position.

Another exercise modality is shown in FIG. 17 in which the exerciser performs core conditioning exercises with the feet engaging the adjustable hold units 44 while the units are in a raised position. In this exercise, the core is conditioned as a stabilizer of the shoulder girdle, giving the upper extremities a solid working foundation. Changing the height of the adjustable hold units alters the angles of the exerciser's body with respect to the floor and intensity of the exercise.

Figure 18:
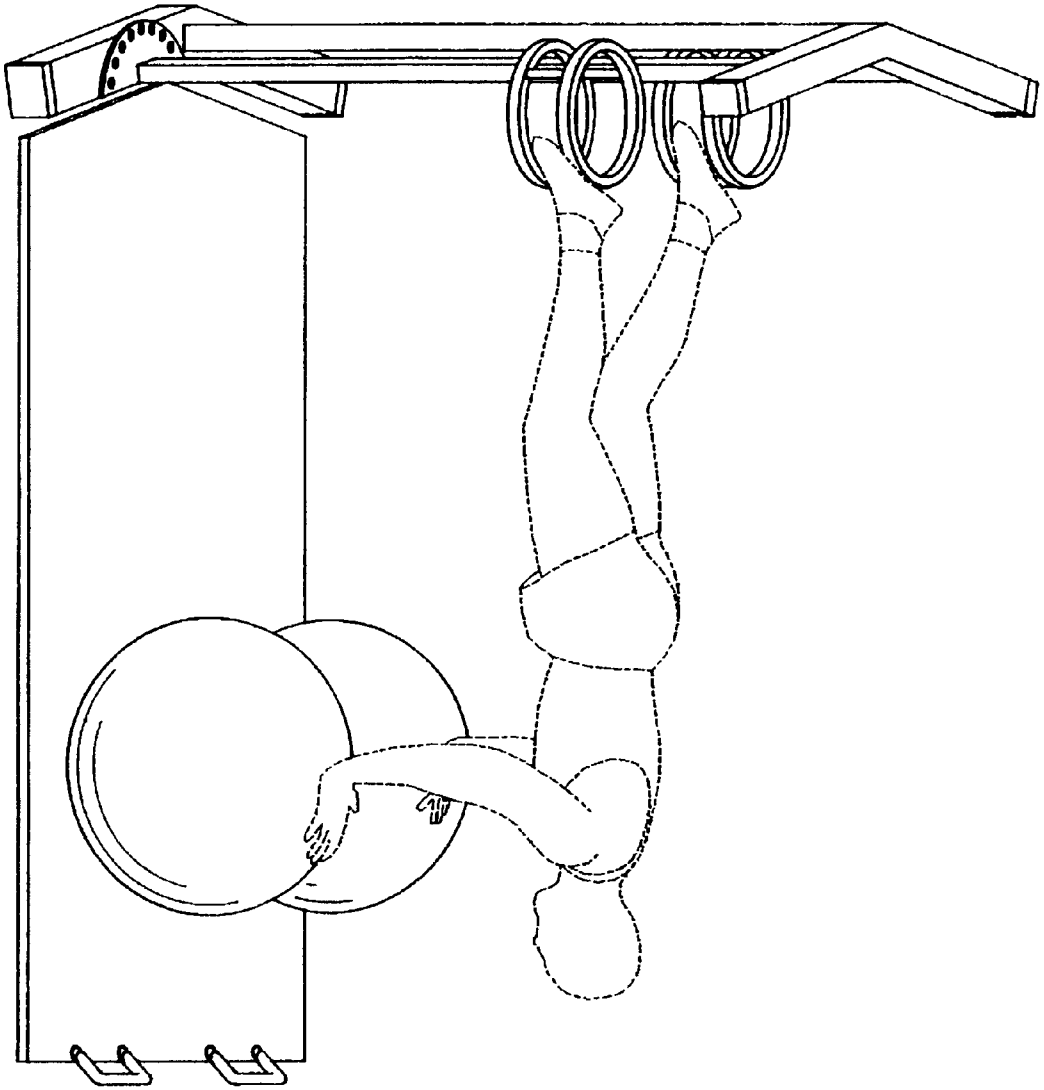
FIG. 18 is a perspective view of the rack exercise system of FIG. 1, showing a person performing an core- conditioning exercises with the feet engaging the adjustable hold units while the units are in a raised and wide position.

Another exercise modality is shown in FIG. 18 in which the exerciser performs core conditioning exercises with the feet engaging the adjustable hold units 44 while the units are in a raised position. This exercise demonstrates the use of multiple Swiss balls 32 to increase the difficulty of the exercise.

Figure 19:
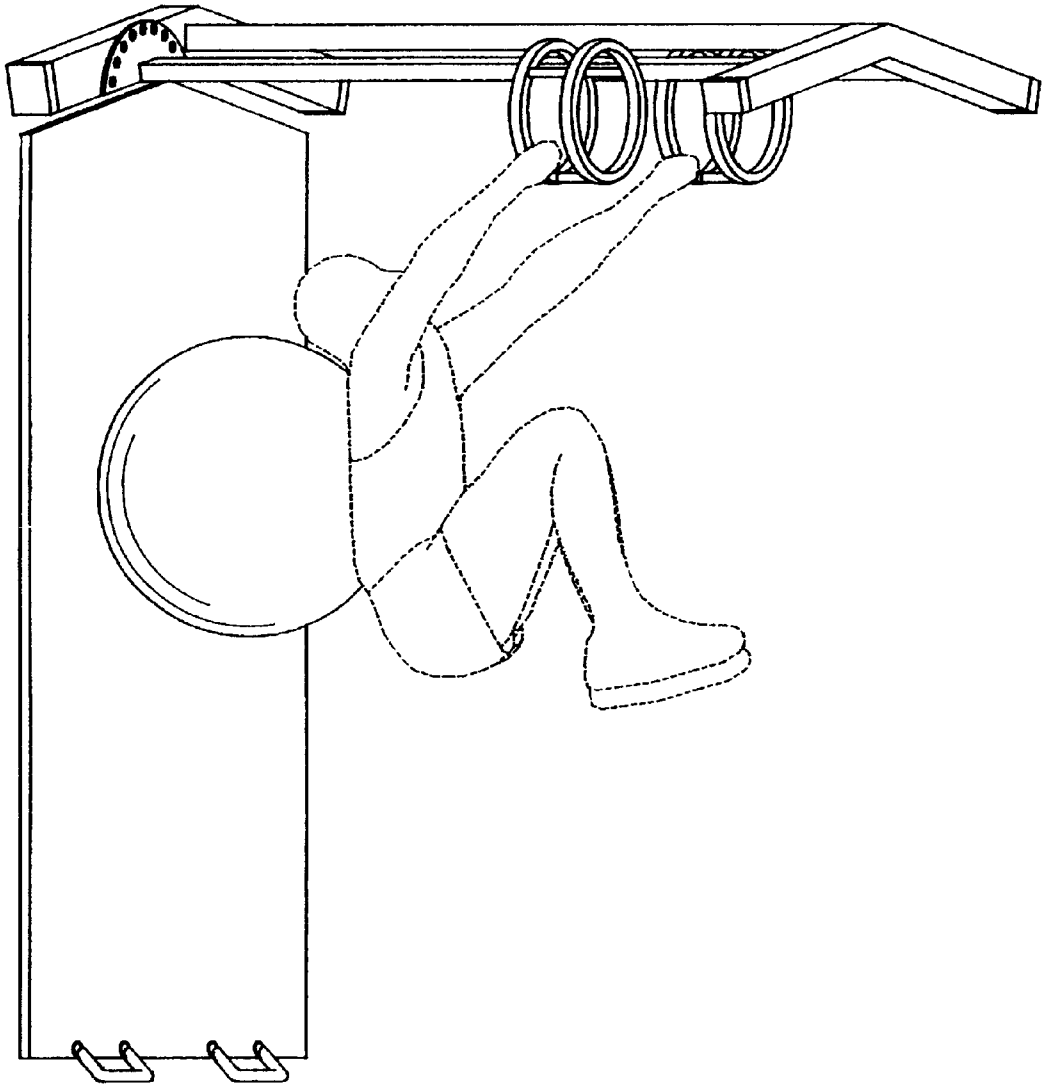
FIG. 19 is a perspective view of the rack exercise system of FIG. 1, showing a person performing an isolation conditioning exercise with the hands grasping the adjustable hold units while the units are in a raised and narrow position.

Another exercise modality is shown in FIG. 19 in which the exerciser performs core conditioning exercises with the feet engaging the adjustable hold units 44 while the units are in a raised position. Flexing the hip and lower portion of the spine allows the exerciser to exercise following a movement pattern not commonly afforded by traditional exercise machines. The rack exercise system 30 of the invention thus allows either isolation (working the abdominals and trunk by locking the hip) or integration (flexing the legs and trunk in sequence) of the trunk and lower extremities.

Figure 20:
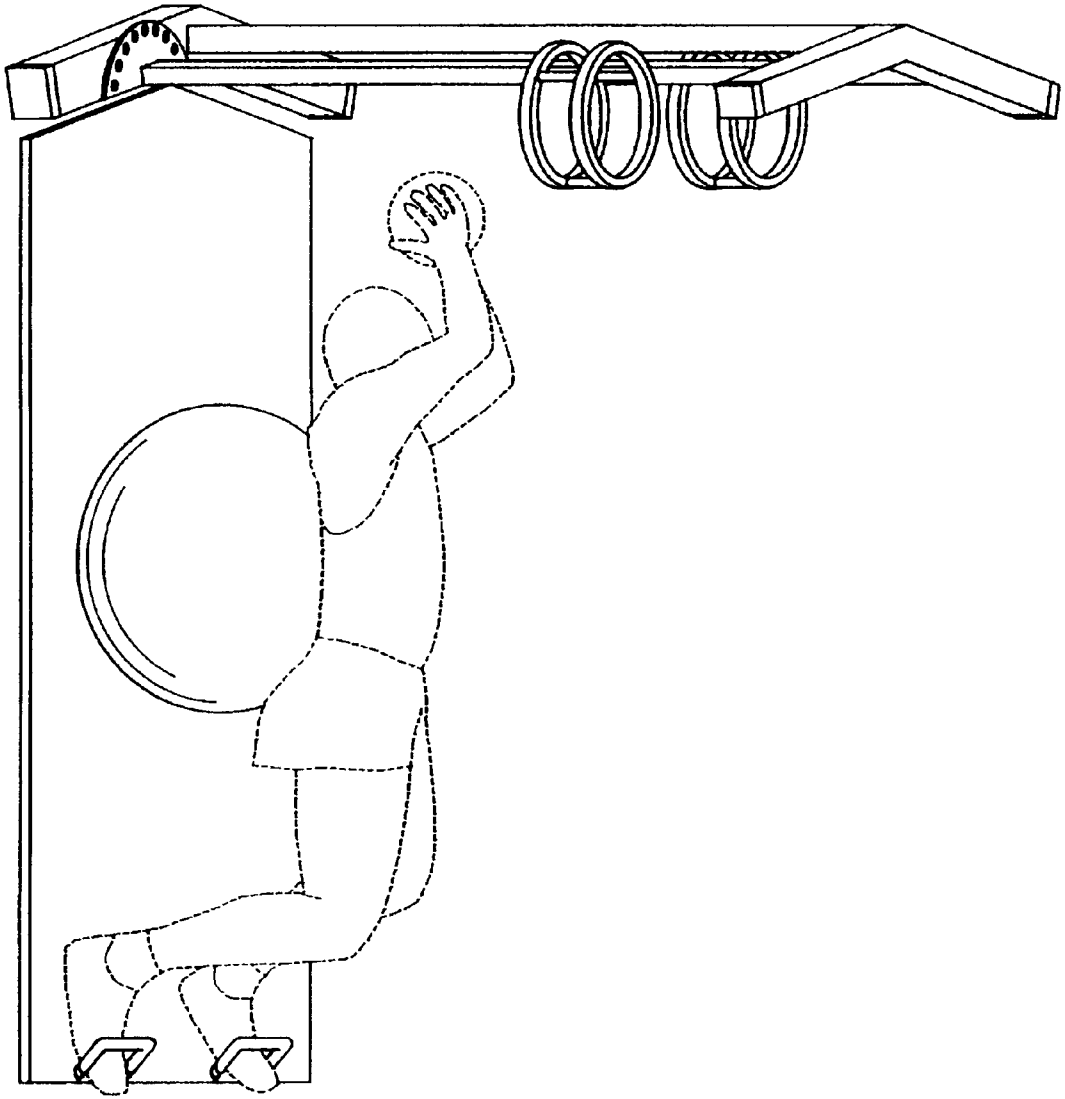
FIG. 20 is a perspective view of the rack exercise system of FIG. 1, showing a person performing core conditioning exercises with the feet engaging the lower swivel hand and foot holds.

Another exercise modality is shown in FIG. 20 in which the exerciser performs upper extremity conditioning using a medicine ball with the feet engaging the lower swivel hand and foot holds 84. In this exercise, the exerciser is free to toss a medicine ball, unobstructed, at any desired angle or speed.

Figure 21:
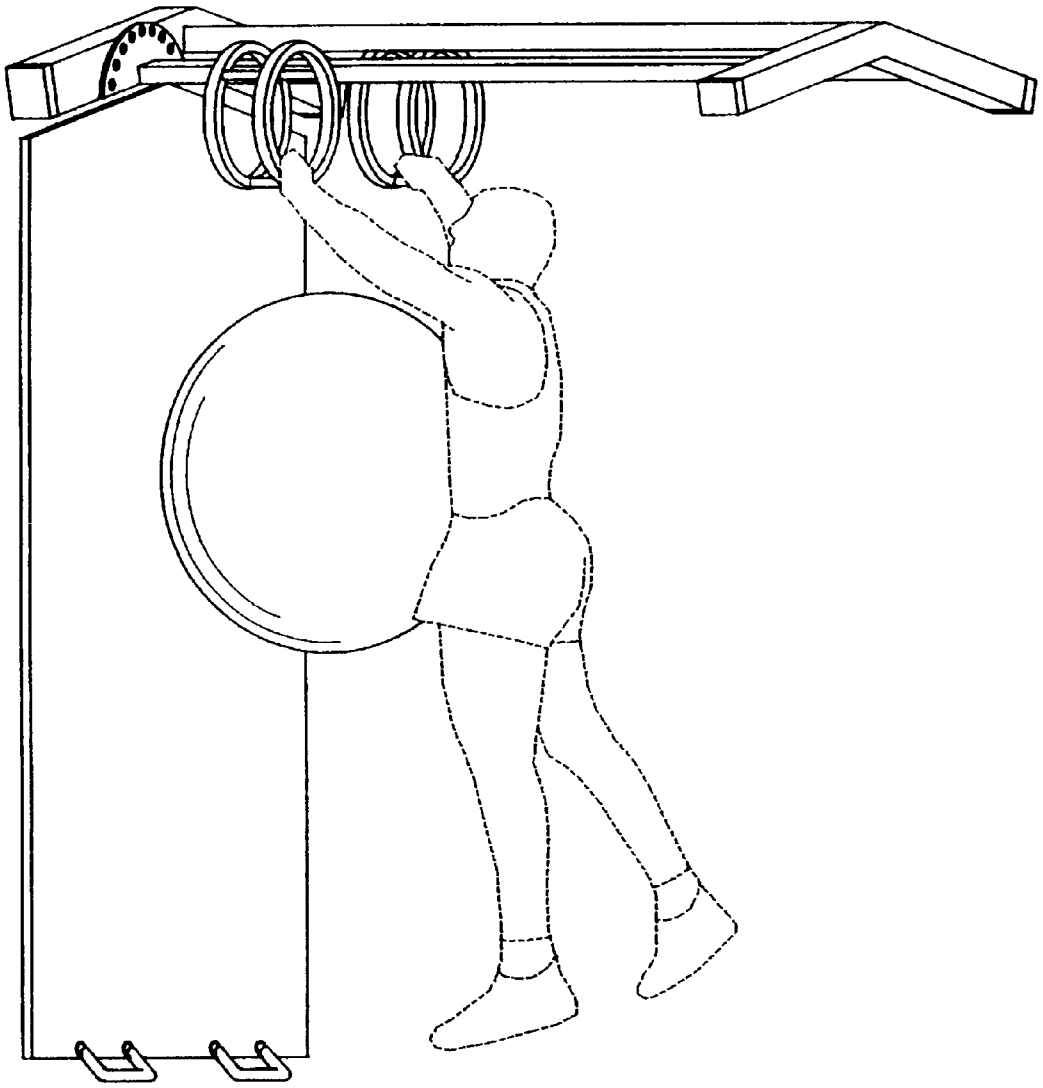
FIG. 21 is a perspective view of the rack exercise system of FIG. 1, showing a person performing core conditioning exercises with the hands grasping the adjustable hold units while the units are in a lowered position.

Another exercise modality is shown in FIG. 21 in which the exerciser performs core conditioning with the hands grasping the adjustable foot and hand hold units 44 while the units are in a lowered position. Exercising with the lower extremities in an open chain environment allows application to such sports as swimming, diving, and gymnastics. This exercise position also allows isolation of the low back by flexing from the hip/back region only, or allows integration by moving the lower extremities in concert with the hip/back region.

Figure 22:
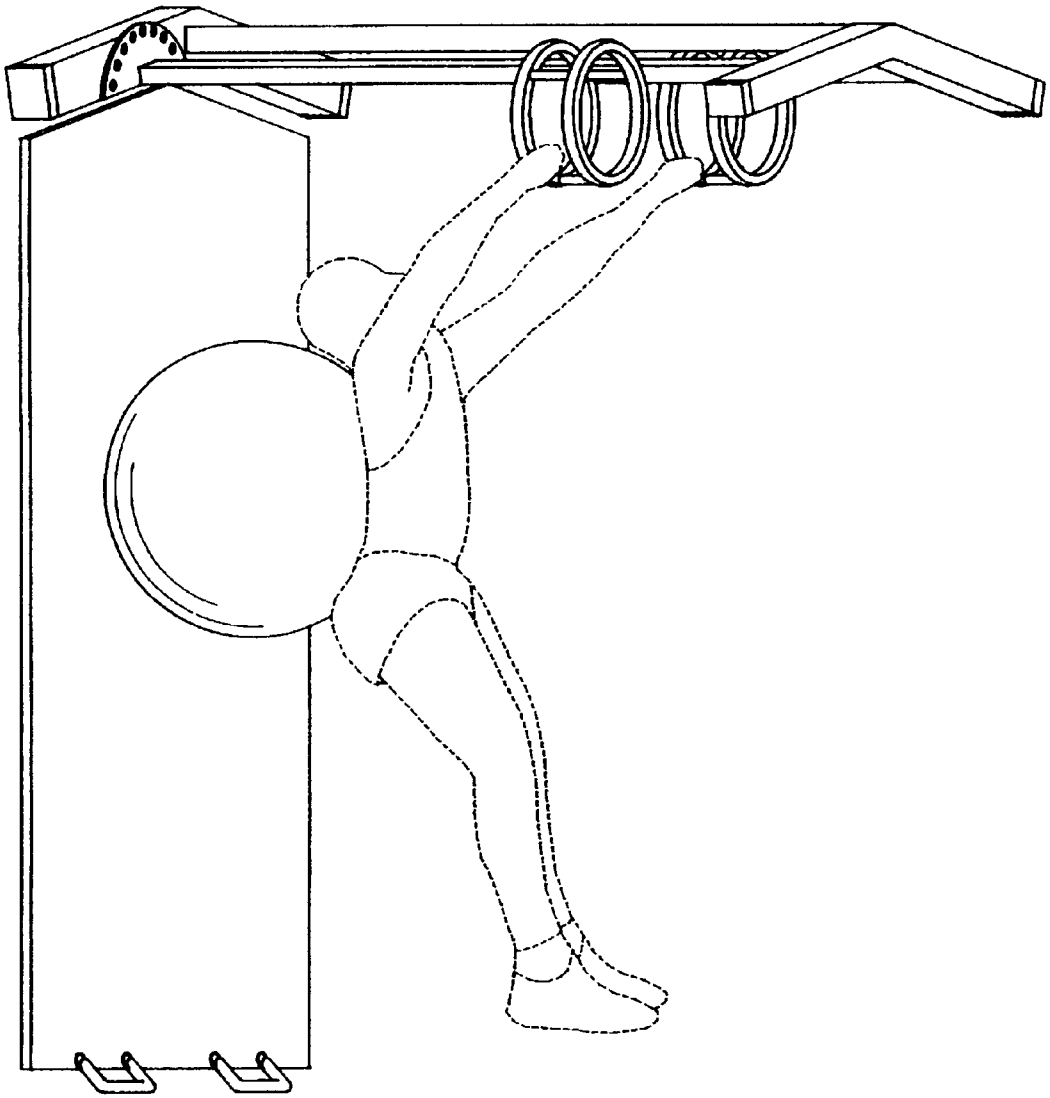
FIG. 22 is a perspective view of the rack exercise system of FIG. 1, showing a person performing a core conditioning exercises with the hands grasping the adjustable hold units while the units are in a raised and narrow position.

Another exercise modality is shown in FIG. 22 in which the exerciser performs core conditioning exercises-with the feet engaging the adjustable hold units 44 while the units are in a raised position. The elevated position of the adjustable hold units allows effective anchoring for hip, trunk and neck flexion exercises from the supine position. This position allows conditioning of movement patterns common to many work or sports situations as well as providing for isolation and/or integration of movement.

Figure 23A:
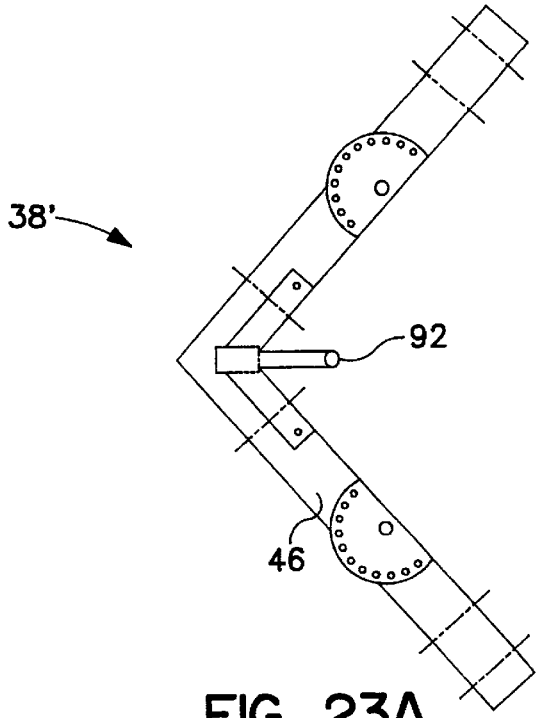
FIG. 23A is a plan view of an alternative embodiment of a rack exercise system, according to the invention, having attached to the main support frame, a center post bar for grasping during conditioning in three-dimensions using the Swiss ball.
Figure 23B:
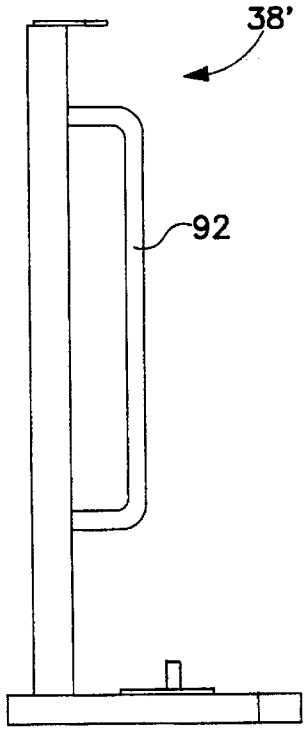
FIG. 23B is a side elevation of the rack exercise system having a center post bar of FIG. 23A.

In an alternative embodiment of the invention, shown in FIGS. 23A and 23B, the rack exercise system 30 includes a main support frame 38' having an additional support bar 92 and the depth of the V configuration on the main supports top clamp and base 46 is increased to allow more head room. The support bar is grasped by the hands and increases the balance conditioning of the exerciser.

Figure 24A:
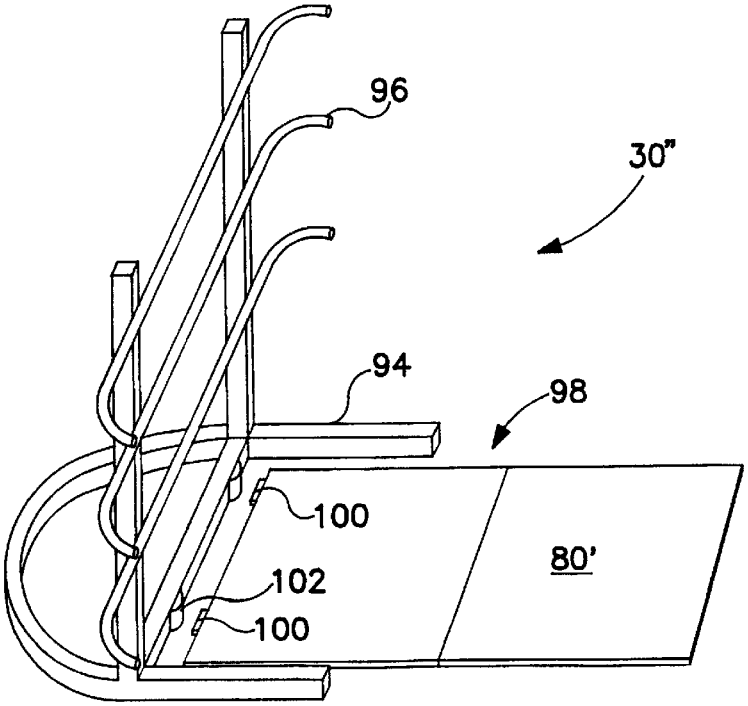
FIG. 24A is a perspective view of an alternative embodiment of a rack exercise system, according to the invention, formed by modifying an existing stationary gym set to have foot and hand support bars for use as supports during conditioning in three-dimensions using the Swiss ball and to have a foldable floor unit.
Figure 24B:
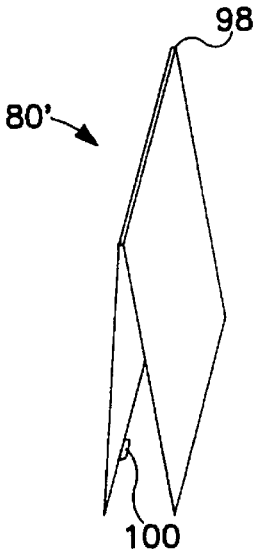
FIG. 24B is a perspective view of the foldable floor unit of FIG. 24A in its folded position for storage.

Another alternative embodiment of the rack exercise system 30" for home use is shown in FIG. 24. The system may be formed by retrofitting an existing exercise system 94 with support bars 96. Further, the floor 80' includes a hinge 98. Also, the floor includes brackets 100 that engage brackets 102 on the exercise system 92. Thus, the floor may be removed, compactly folded, and stored in a convenient location when not in use.

It should be readily apparent that the rack exercise system 30 of the invention provides a core-conditioning device having numerous possibilities for conditioning the extremities. Among other features, the rack exercise system of the invention provides the following unique features:

1. The system has the ability to serve as a multi-position, multi-angle, multi-plane anchor system, allowing the execution of numerous exercises. The system provides for easy and effective anchoring of hands, feet, or any combination thereof.
2. The system has the ability to integrate other exercise apparatus or modalities.
3. The system has the ability to be used as an anchor system for performance of body weight resistance exercises without the addition of any other apparatus or modality.
4. By design, the system is unique in that multiple types of training can be performed, whereas most existing equipment, gimmicks, and apparatus in the exercise industry are targeted at a "specific" movement or activity.
5. The system is unique in that it allows the practitioner/user to create exercises that "isolate" or "integrate" specific regions of the human body.
6. The system requires that the user "self stabilize". This unique self-stabilization feature ensures that the user improves the stabilization skills and abilities necessary for function in the three dimensionally unstable (gravity loaded) environment we live in as human beings. Most machines and training devices attempting to allow exercise options for specific muscles do not require any significant degree of stabilization. This is due to the fact that the user is either belted into a heavy stable machine and/or the exercise(s) are performed by moving levers which have a fixed or semi-fixed axis of motion.
7. The system provides an anchoring system allowing performance of high-resistance, high-speed, unstable exercises that would otherwise be high-risk or dangerous should the user depend on insecure anchors or anchors that are actually objects not intended to serve as an anchor for such exercises. Such objects do not have adequate handholds in positions or sizes that suit the human hand; therefore slippage is likely, as is injury. Also, such objects and machines are often not bolted down and may be light or unstable enough that tipping or falling over is a realistic possibility in consideration of the forces generated with many of the exercises athletes attempt when holding onto such items. Further, machines have multiple moving parts which look secure but may move as load increases. The person using such an apparatus as an anchor also may interrupt normal gym traffic, or may suffer injury if another person attempts to use the machine while it is being used as an anchor.
8. The system allows the user to move at "unlimited" speeds of motion, as there are no moving parts once the anchor height, angle and location are selected and the spring-loaded pins are set.
9. The system allows for explosive or "plyometric" exercises targeting the trunk musculature to be performed in any plane of motion or combination thereof.
10. The adjustability of the system allows use by adults and children of any size or shape.

While the foregoing has been with reference to specific embodiments of the invention, it will be appreciated by those skilled in the art that these are illustrations only and that changes in these embodiments can be made without departing from the principles of the invention, the scope of which is defined by the appended claims.

What is claimed is:

1. A method for conditioning a person's body, comprising the steps of anchoring one, but not both, of the person's extremities to anchor points;

balancing independently weight of at least the trunk of the body on a freely rollable support; and having the person perform exercise maneuvers.

2. A conditioning method as defined in claim 1, wherein the balancing the body on a freely rollable support is achieved by balancing the weight of at least the trunk atop a Swiss ball.

3. A conditioning method as defined in claim 1, wherein the balancing comprises compensating with the muscles of the trunk for movement of the freely rollable support in response to the exercise maneuvers.

4. A conditioning method as defined in claim 1, wherein performing exercise maneuvers includes throwing a medicine ball in a three-dimensional movement.

5. A conditioning method as defined in claim 1, wherein the anchoring comprises anchoring the person's extremities to anchor points on a rack exercise system.

6. A conditioning method as defined in claim 5 wherein the rack exercise system includes an upright unit having adjustable hold units for anchoring and a floor unit having swivel holds for anchoring.

7. A rack exercise system comprising an upright unit having adjustable hold units for anchoring a person's extremities and a floor unit having swivel holds also for anchoring a person's extremities.

8. A rack exercise system as defined in claim 7, wherein the upright unit comprises:

a main support frame having a main support base, a main support post attached to the main support base and extending in up from the base and the floor unit, and at least two angle selection plates attached to the main support base, each angle selection plate having a peg surrounded by a plurality of pin holes defining selectable angles;

at least two upright support racks that are each mounted between a respective angle selection plate and the main support post such that the rack may swivel about the peg of the respective angle selection plate, and each rack having a pin for selectably engaging the pin holes in the respective angle selection plate;

at least two adjustable hold units that each slidingly engage a respective upright support rack, wherein each hold unit may be adjustably set to a predetermined location along the respective upright support rack.

9. A rack exercise system as defined in claim 8, wherein each upright support rack has holes at predetermined locations along the support rack and each adjustable hold unit has a spring-load pin for engaging one of the support rack holes to set the location of the respective hold unit along the support rack.

10. A rack exercise system as defined in claim 7, wherein the floor unit further includes a base frame, a floor attached over the base frame, and a gymnastic pad that covers the floor.

11. A rack exercise system as defined in claim 10, wherein the swivel holds are attached to the base frame.

12. A rack exercise system as defined in claim 7, further comprising an mobile support for supporting a person during exercise.

13. A rack exercise system as defined in claim 12, wherein the mobile support is a Swiss ball.

14. Apparatus for exercise, comprising:

anchor means for providing an attachment point for one, but not both, of a person's extremities during performance of exercise; and freely rollable support means independent of the anchor means for balancing the weight of the person's trunk and moveable portions of the body during performance of exercise to allow integrated conditioning of the person's truck muscles and extremity muscles.

* * * * *